US005697010A

United States Patent [19]

Masuda et al.

[11] Patent Number: 5,697,010

[45] Date of Patent: Dec. 9, 1997

[54] IMAGE FORMING APPARATUS HAVING DETECTION MEANS TO MAINTAIN IMAGE FORMATION CONDITION

[75] Inventors: Koji Masuda; Kensaku Kusaka, both of Kawasaki; Hidekazu Maruta, Yokohama; Hideki Fujita, Kawasaki; Takahiro Noguchi, Yokohama, all of Japan

[73] Assignee: Canon Kabushiki Kaisha, Tokyo, Japan

[21] Appl. No.: 517,680

[22] Filed: Aug. 22, 1995

[30] Foreign Application Priority Data

Aug. 22, 1994 [JP] Japan ..... 6-221116
Aug. 22, 1994 [JP] Japan ..... 6-221117

[51] Int. Cl.[6] ..... G03G 15/00

[52] U.S. Cl. ..... 399/46; 399/48; 399/174

[58] Field of Search ..... 355/219, 208, 355/205, 200, 207; 361/220, 221, 225, 222, 212; 399/50, 46, 48, 168, 174, 175, 176

[56] References Cited

U.S. PATENT DOCUMENTS

| | | | |
|---|---|---|---|
| 3,788,739 | 1/1974 | Coriale | 355/219 X |
| 4,823,689 | 4/1989 | Kishino et al. | 100/155 R |
| 4,837,600 | 6/1989 | Kasai et al. | 355/219 X |
| 4,939,542 | 7/1990 | Kurando et al. | 355/219 X |
| 5,012,279 | 4/1991 | Nakajima et al. | 355/205 |
| 5,162,634 | 11/1992 | Kusaka et al. | 219/216 |
| 5,471,283 | 11/1995 | Irihara et al. | 355/219 X |

FOREIGN PATENT DOCUMENTS

| | | |
|---|---|---|
| 0525616 | 2/1993 | European Pat. Off. . |
| 0568352 | 11/1993 | European Pat. Off. . |
| 0579499 | 1/1994 | European Pat. Off. . |
| 2934337 | 2/1980 | Germany . |
| 63-313182 | 12/1988 | Japan . |
| 2-157878 | 6/1990 | Japan . |

*Primary Examiner*—S. Lee
*Attorney, Agent, or Firm*—Fitzpatrick, Cella, Harper & Scinto

[57] ABSTRACT

Imaging forming apparatus includes an image bearing member, an image formation unit for forming an image on the image bearing member, and a detection unit for detecting a voltage-current characteristic between the image bearing member and the charging member. The image formation unit has a charging member contactable to the image bearing member to charge the image bearing member. An image formation condition for the image bearing member is determined on the basis of a plurality of detection operations of the detection unit.

45 Claims, 16 Drawing Sheets

IMAGE FORMING APPARATUS HAVING DETECTION MEANS TO MAINTAIN IMAGE FORMATION CONDITION

FIELD OF THE INVENTION AND RELATED ART

The present invention relates to an image forming apparatus such as an electrophotographic apparatus, (copying machine, light printer) for executing image formation using a transfer type (indirect type) or direct type image formation process including a charging step for a surface of the image bearing member (electrophotographic photosensitive member to be charged or electrostatic recording dielectric member).

More particularly, it relates to an image forming apparatus using a contact type charging device for charging the surface of the member to be charged by contacting a charging member supplied with a voltage to the member to be charged.

As a means for charging the surface of the image bearing member (member to be charged) in such an image forming apparatus, a corona discharge device having a wire and a shield, are widely used.

The corona discharge device is effective as a means for uniformly charging the surface of the member to be charged such as the image bearing member to a predetermined potential. However, it requires a high voltage source, and ozone not preferable for corona discharge is produced.

Another type charging means has been developed. A charging member supplied with a voltage is contacted to the surface of the member to be charged to charge the surface (contact type charging device). This is advantageous in that the voltage of the voltage source is low, and the amount of produced ozone is small. It is now used as charging means for charging a surface of the member to be charged such as a photosensitive member or a dielectric member in place of the corona discharge device.

FIG. 15 is a sectional view of a contact type charging device according to an embodiment of the present invention.

In this Figure, designated by 1 is a member to be charged. It is in the form of an electrophotographic photosensitive member of a rotation drum type (photosensitive member) in this embodiment. The photosensitive member 1 comprises an electroconductive base layer 1*b* of aluminum or the like and a photoconductive layer 1*a* thereon, as basic layers.

Designated by 2 is a charging member. In this exemplary, it is of a roller type (charging roller). The charging roller 2 comprises a central core metal 2*c*, an electroconductive layer 2*b* thereon, and a resistance layer 2*a* thereon.

Designated by P is a bias application voltage source for the charging roller 2. A voltage source P and the core metal 2*c* of the charging roller 2 is electrically connected so that a predetermined DC bias is applied to the charging roller 2 from the voltage source P.

When the photosensitive member 1 as the member to be charged is rotated, the charging roller 2 press-contacted to the photosensitive member 1 and supplied with the bias voltage charges the outer peripheral surface of the photosensitive member 1 to a predetermined polarity and potential.

Around the circumference of the photosensitive member 1, as shown in FIG. 1 which will be described in detail hereinafter, there are disposed in addition to the charging roller 2, exposure means, development means, transfer means, cleaning means, image fixing means or another image formation process means to constitute an image formation mechanism. These means are omitted in this Figure for simplicity.

With an increase in the number of image formations in such an image forming apparatus, the outer peripheral surface of the photosensitive member is scraped by the cleaning blade of the cleaning means, developer or the like. By the equivalent capacity change due to the decrease of the thickness of the photosensitive layer 1*a*, the charging property changes.

Particularly, in the case of DC voltage application of contact type, the influence of the capacity change of the photosensitive member is significant. More particularly, when the film thickness of the photosensitive layer decreases with increase of the number of operations for the image formation, the DC current through the charging roller increases with the result of an increase of the surface potential of the outer peripheral surface of the photosensitive member. When the surface potential increases as a result of the decrease of the film thickness of the photosensitive layer, the development contrast increases, and therefore, the development image density increases, and in addition, no sufficient opposite contrast relative to the potential of the white image is provided, so that the white portion is slightly developed (fog).

When the thickness of the photosensitive member decreases, the surface potential increases, and therefore, the light portion potential of the surface potential increases. Since the photosensitive member photosensitivity decreases when film thickness decrease, the surface potential corresponding to the white original, namely, is not low enough. Because of them, the surface potential contrast between the black and white portions of the original decreases in the developed image. If the attempt is made to provide a sufficient development contrast upon development, fog is produced.

In order to avoid such problems, EPA579499 proposes that when the charging roller is contacted to the non-image formation region of the photosensitive member, the charging roller is subjected to a DC constant voltage control, and the DC current amount which corresponds to the photosensitive layer film thickness at that time is detected. When the charging roller corresponds to the image formation region of the photosensitive member, the DC voltage charging roller is subjected to the constant voltage control with the DC current amount responsive to the detected current. This control system will be called "APVC control".

However, in the conventional example, the constant voltage control is effected to the charging roller only in response to the DC current amount detected during one DC constant voltage control of the charging roller, and therefore, the following problem arises.

After one APVC control is carried out, the detection current changes due to the ambience factors such as noise, malfunction of the contacts, electrical accuracy variation, even if the thickness of the photosensitive layer decreases because of the number of operations is small. If this occurs, the charging roller is controlled by the DC constant voltage control in accordance with the ambience factors with the result of improper image density. If this occurs, stable image formations are not possible.

SUMMARY OF THE INVENTION

Accordingly, it is a principal object of the present invention to provide an image forming apparatus capable of forming good images despite the reduction of the thickness of the image bearing member.

It is another object of the present invention to provide an image forming apparatus with which fog is not produced even if the apparatus is operated for a long term.

It is a further object of the present invention to provide an image forming apparatus wherein the rise of the surface potential of the image bearing member due to the long term use is prevented.

It is a further object of the present invention to provide an image forming apparatus wherein the limitation for the image formation condition upon the decrease of the thickness of the image bearing member, can be accurately effected.

While the invention has been described with reference to the structures disclosed herein, it is not confined to the details set forth and this application is intended to cover such modifications or changes as may come within the purpose of the improvements or the scope of the following claims.

DESCRIPTION OF THE PREFERRED EMBODIMENT

Embodiment 1

(1) An example of an image forming apparatus

Figure 1:
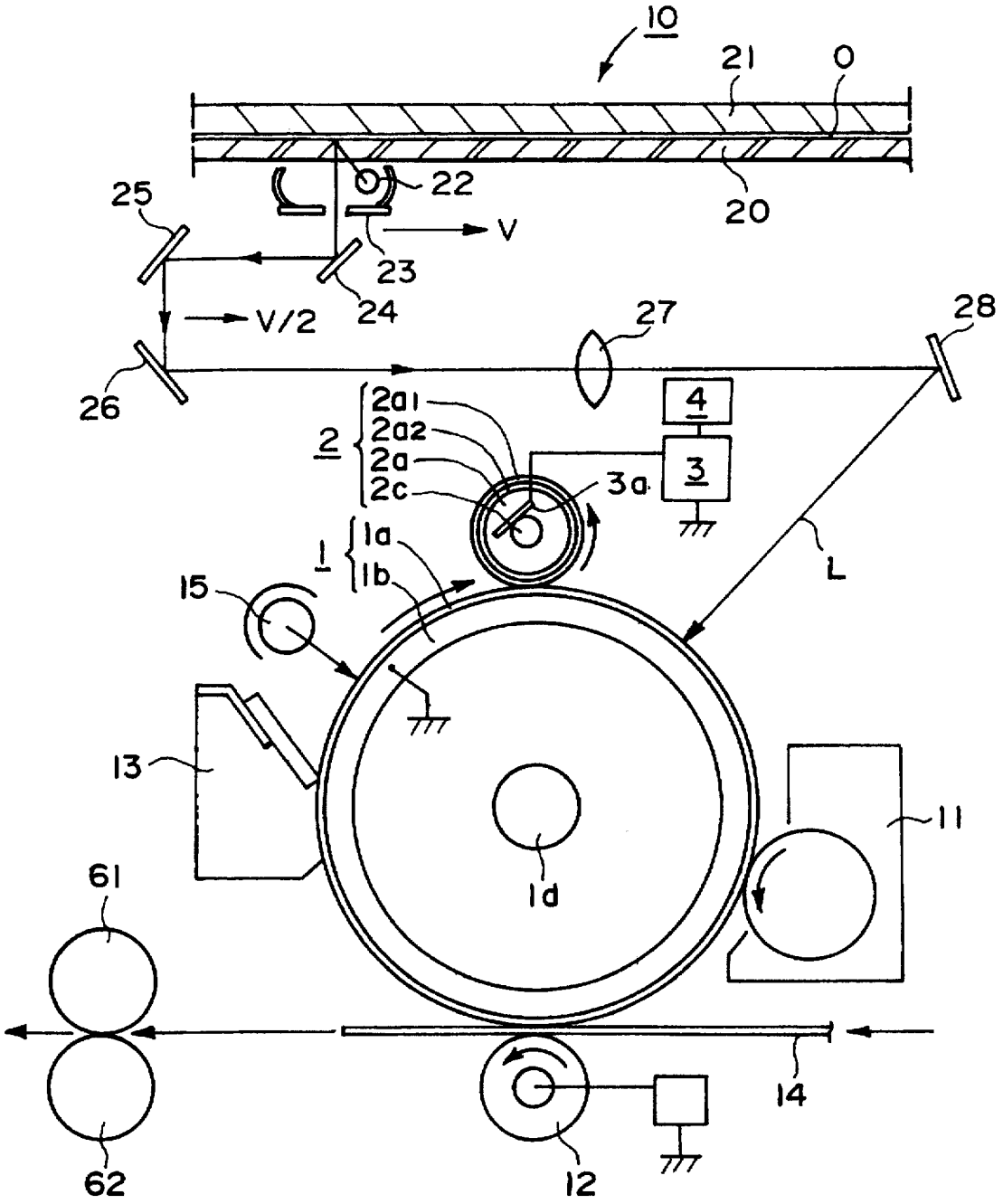
FIG. 1 is a schematic illustration of an image forming apparatus.

FIG. 1 is a schematic structure of an example of an image forming apparatus according to the present invention.

Designated by 1 is an image bearing member as a member to be charged, which comprises an electroconductive base layer 1*b* of grounded aluminum or the like, and a photoconductive layer 1*a* thereon, as major layers (electrophotographic photosensitive member). It is rotated at a predetermined peripheral speed (process speed) in a clockwise direction in the Figure, about a supporting shaft 1*d*.

Designated by 2 is a contact charging member for effecting uniform primary charging for the surface of the photosensitive member to a predetermined polarity and potential by contact thereto, and it is of a roller type (charging roller) in this exemplary. The charging roller 2 comprises a center core metal 2*c*, an electroconductive layer 2*b* thereon, and two layers thereon, which include a resistance layer $2a_2$s and $2a_1$ formed in this order. It is supported by bearings at opposite ends, by unshown bearing members and is press-contacted to the photosensitive member 1 of drum type with a predetermined pressure by unshown urging means, so that it is rotated by the rotation of the photosensitive member 1.

A predetermined current is supplied to the core metal 2*c* through a sliding contact 3*a* from the voltage source 3, by which the peripheral surface of the rotation photosensitive member 1 is charged to the predetermined polarity and potential (contact charging, primary charging).

The surface of the photosensitive member 1 having been subjected to the uniform charging by the charging member 2, is exposed to the exposure L of object image information by exposure means 10 (imaging slit exposure, laser beam scanning exposure or the like), so that an electrostatic latent image is formed on the peripheral surface thereof corresponding to the intended image information.

The exposure means 10 of the device of this exemplary is an original image imaging slit exposure means of a known stationary original carriage and movable optical system. Designated by 20 is a fixed original carriage glass, O is an original placed face-down on the original carriage glass, 21 is an original confining plate, 22 is an original illumination lamp (exposure for lamp), 23 is a slit plate, 24–26 are movable first to third mirrors, 27 is an imaging lens, and 28 is a fixed mirror. The lamp 22, slit plate 23 and movable first mirror 24 are moved at a predetermined sped from one end to the other end below the lower surface of the original carriage glass 20, and the movable second and third mirrors 25 and 26 are moved at a speed of V/2, so that the face down surface of the original is scanned from one side to the other side, and the image of the original is scanned and projected onto the surface of the photosensitive member 1.

The formed latent image is visualized by the development means 11 into a toner image. The toner image is transferred onto the surface of a transfer material 14 fed to a transfer portion between the photosensitive member 1 and the transfer means 12 at a proper timing in synchronism with the sequential of the photosensitive member 1 from unshown sheet feeding means portion. The transfer means 12 of this embodiment is a transfer roller, and its charge is the opposite polarity of the toner on the transfer material 14, so that the toner image is transferred from the photosensitive member 1 to the surface of the transfer material 14.

The transfer material 14 now having the toner image is separated from the surface of the photosensitive member 1, and is fed to the image fixing means having the heat roller 61 and the pressing roller 62, so that the image is fixed. It is then discharged as a print. In the case of both side printing, the transfer material is fed back to the transfer portion by refeeding means.

The surface of the photosensitive member 1 after the image transfer, is cleaned by the cleaning means 13 so that the deposition contamination or the like or the residual toner is removed. Then, it is electrically discharged to be prepared for the next image formation.

(2) Various examples of the charging member 2

The roller type charging member 2 may be rotated by the photosensitive member 1 as the member to be charged, or may be non-rotatable, or it may be positively rotated codirectionally or counterdirectionally at a proper peripheral speed.

The charging member 2 may be a blade-like type, block-like type, rod-like type, belt-like type, or the like.

Figure 2A:
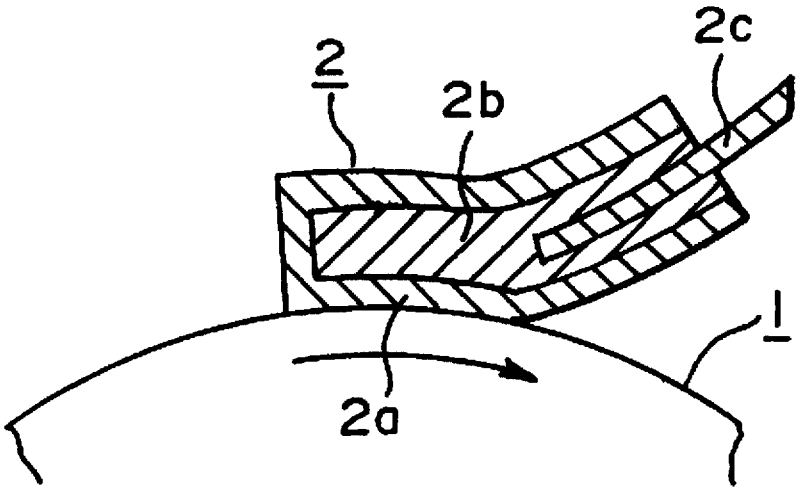
FIG. 2(*a*) is a sectional view and FIG. 2(*b*) is a schematic illustration of a type other than a roller type.
Figure 2B:
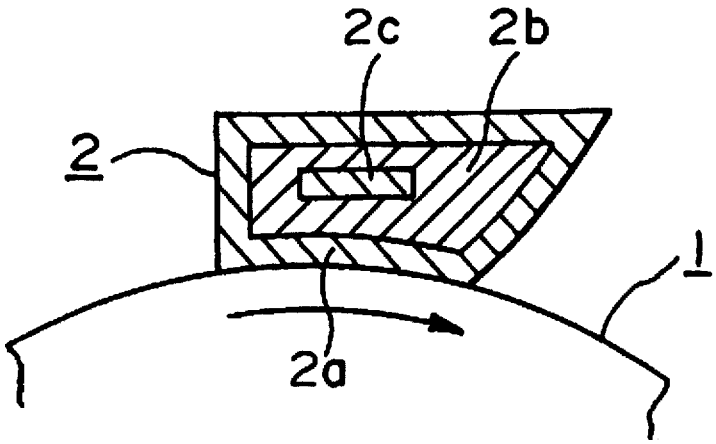

FIG. 2(*a*) is a schematic sectional view of example which is a blade-like type. In this case, the direction of the blade-like charging member 2 contacted to the surface of the photosensitive member 1 may be codirectional or counterdirectional with respect to the movement direction of the surface of the photosensitive member 1.

FIG. 2(*b*) shows example of block-like or rod-like charging member.

In the charging member 2 of various type, reference numeral 2*c* is an electroconductive core metal member, 2*b* is an electroconductive layer, and 2*a* is a resistance layer.

In the case of block-like and rod-like members, there is no need to use an electric energy supply for the sliding contact for the application of the bias voltage to the core metal member 2*c*, which is required by the roller type. The lead line can be directly connected. The electrical noise liable to occur at the electric energy supply for sliding contact 3*a* can be avoided, and in addition, the required space can be saved, and it can be also used as the cleaning blade.

(3) operational sequence

Figure 3:
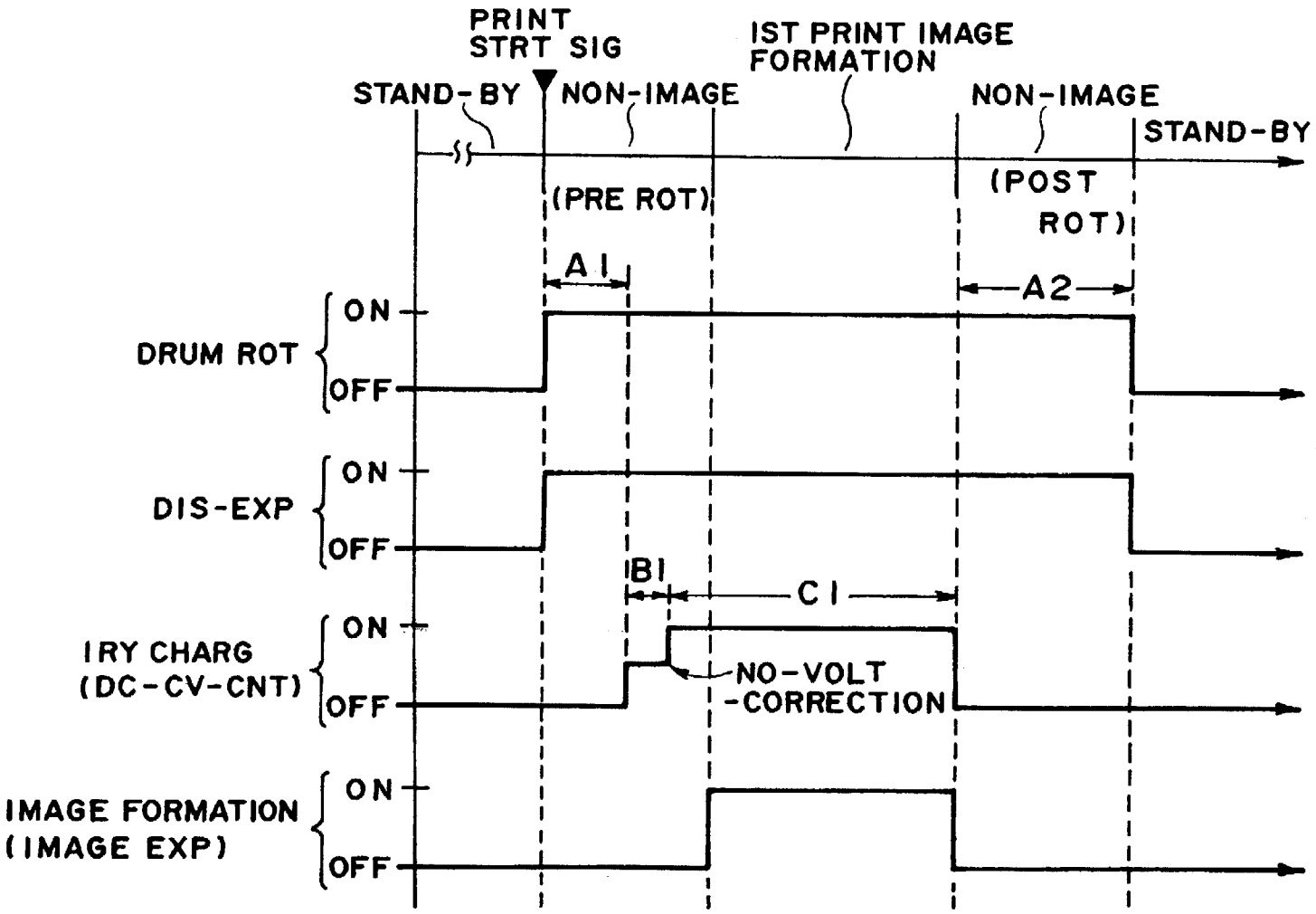
FIG. 3 shows an operation sequence of the device (example 1).
Figure 4:
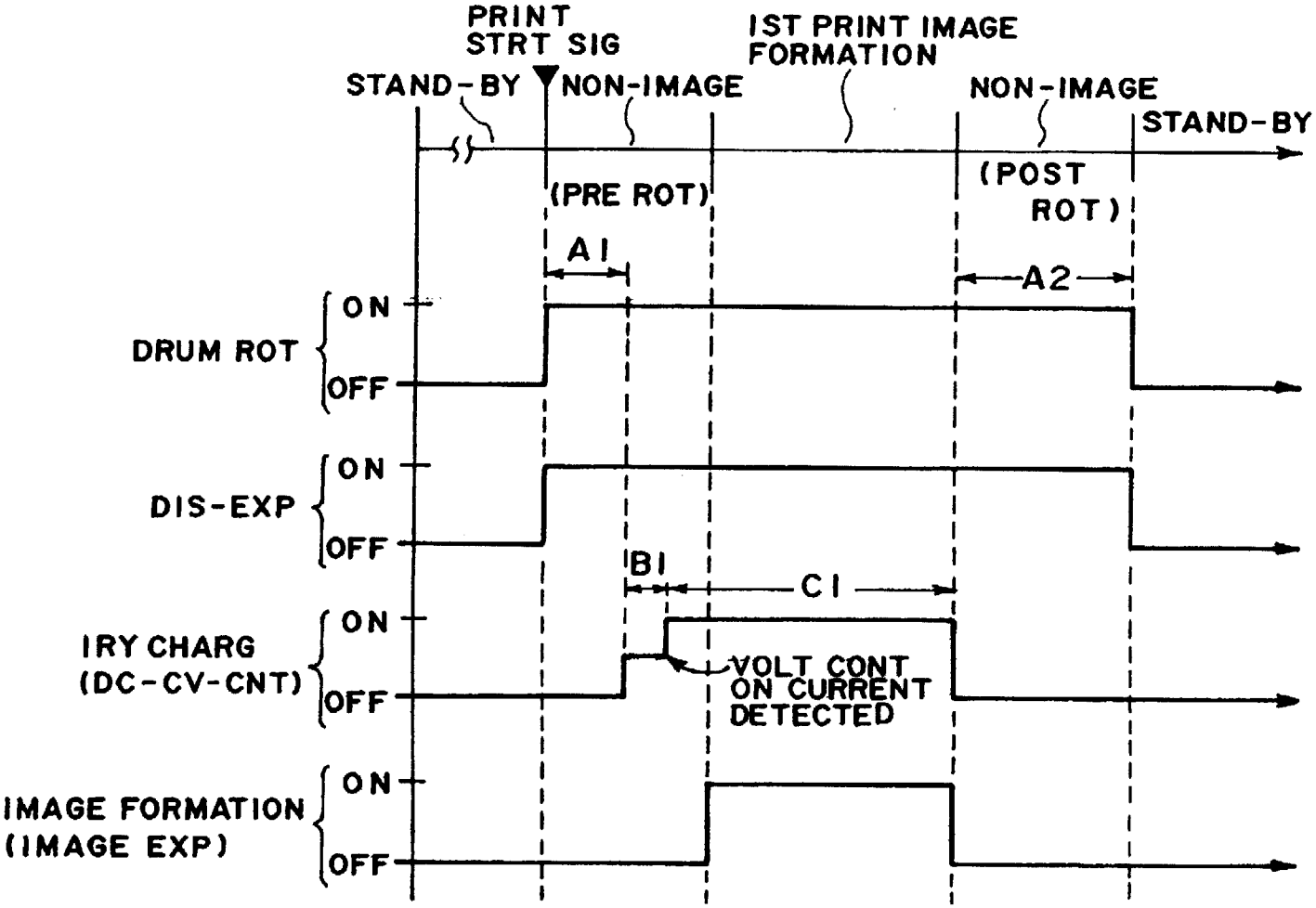
FIG. 4 shows an operation sequence of a device (example 2).

FIGS. 3 and 4 show an example of the operation sequence of the device of FIG. 1. In this exemplary, the comparison is made between after 10 printing operations (FIG. 3), and after 1000 printing operations (FIG. 4), when 1000 operations are carried out.

1) 10 operations (FIG. 3)

<1> on the print (copy) start signal produced by depressing a copy key, the rotation of the photosensitive member 1 (drum) of the device under the stand-by state starts to rotate (pre-rotation). Simultaneously with the rotation start of the drum 1, the discharging exposure device 15 is actuated, so that the drum 1 is electrically discharged in the section A1 more than one full-turn.

<2> subsequently, the DC bias voltage which is a primary charging bias to the charging roller 2 is supplied.

<3> the primary charging bias is subjected to the constant voltage control in the section B1 at first, and during this period, the DC current flowing from the charging roller 2 to the drum 1 is detected in the voltage source 3.

<4> the detection current $I_{10}$ (after 10 printing operations) and the previous detected current $I_9$ (after 9 printing operations) stored in RAM4 are different from each other, but the charging roller is subjected to the same constant voltage control. This is because, the difference is deemed as the detection variation. Actually, the film thickness of the photosensitive layer is hardly different from the initial level.

2) 1000 operations

The same operations as <1>–<3> are carried out.

<4> the detection current $I_{1000}$ (after 1000 operations) and the detection current $I_{999}$ (after 999 operations) are the same, and the charging roller is subjected to the constant voltage control with the DC voltage corresponding to the $I_{1000}$. Because the film thickness of the photosensitive layer decreases by the 1000th operation, it is preferable to effect the constant voltage control for the charging roller with the DC voltage corresponding to the film thickness.

Before the start of the image formation, the pre-rotation continues, and therefore, the drum 1 surface during this period is the non-image formation region. During this section B1, the charging roller is subjected to the DC constant voltage control, and the DC current is detected, and the primary voltage correction (primary charging bias correction to the charging roller 2) is carried out.

After the charging roller DC constant voltage control is started with the primary correction voltage, the image exposure is effected (imaging slit exposure of the original image). The charging roller 2 now corresponds to the image formation region (the surface portion on which the image is going to be formed), and therefore, the charging is effected under the DC constant voltage control to the roller 2.

<6> after the completion of the image formation, the drum 1 goes into the post-rotation period (section A2), during which the discharging exposure device 15 is operated for more than one rotation. Then, the rotation of the drum 1 and the discharging exposure are stopped. The device is placed in the stand-by state until the production of the next print start signal.

(4) voltage correction method

The description will be made as to the method for affecting proper charging using a DC voltage source 3.

The charging mechanism when the DC voltage is applied to the charging roller 2 from a DC voltage source will be described.

The photosensitive layer 1*a* is a negative polarity OPC. More particularly, CGL layer (carrier generating layer) is of azo-pigment, and the CTL layer (carrier transfer layer) is of a mixture of hydrazone and resin material having a thickness of 24 microns, thus constituting a negative property organic photoconductor (OPC layer). The OPC photosensitive drum 1 is rotated and is discharged substantially to 0 V. The discharged surface of the photosensitive member is contacted in the dark by the charging roller 2 supplied with a DC voltage $V_{DC}$ to charge the OPC photosensitive drum 1. The relation between the surface potential $V_D$ of the OPC photosensitive drum 1 after the charging by the charging roller and the application DC voltage $V_{DC}$ applied to the charging roller 2 is investigated.

Figure 5A:
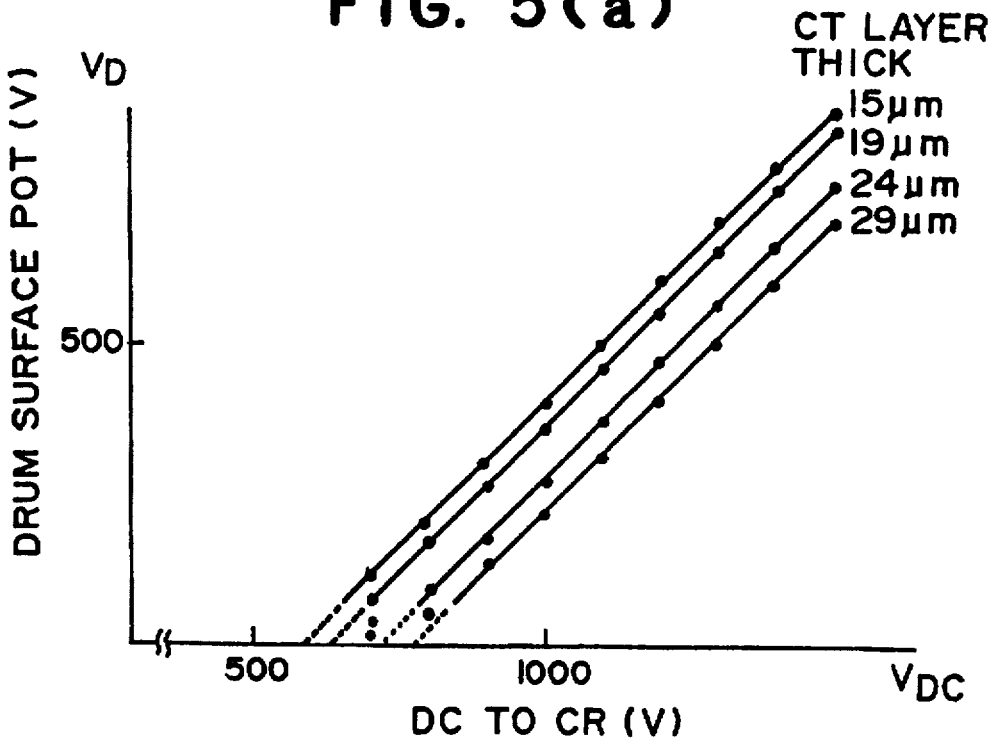
FIGS. 5(*a*) and 5(*b*) are graphs of charging properties.
Figure 5B:
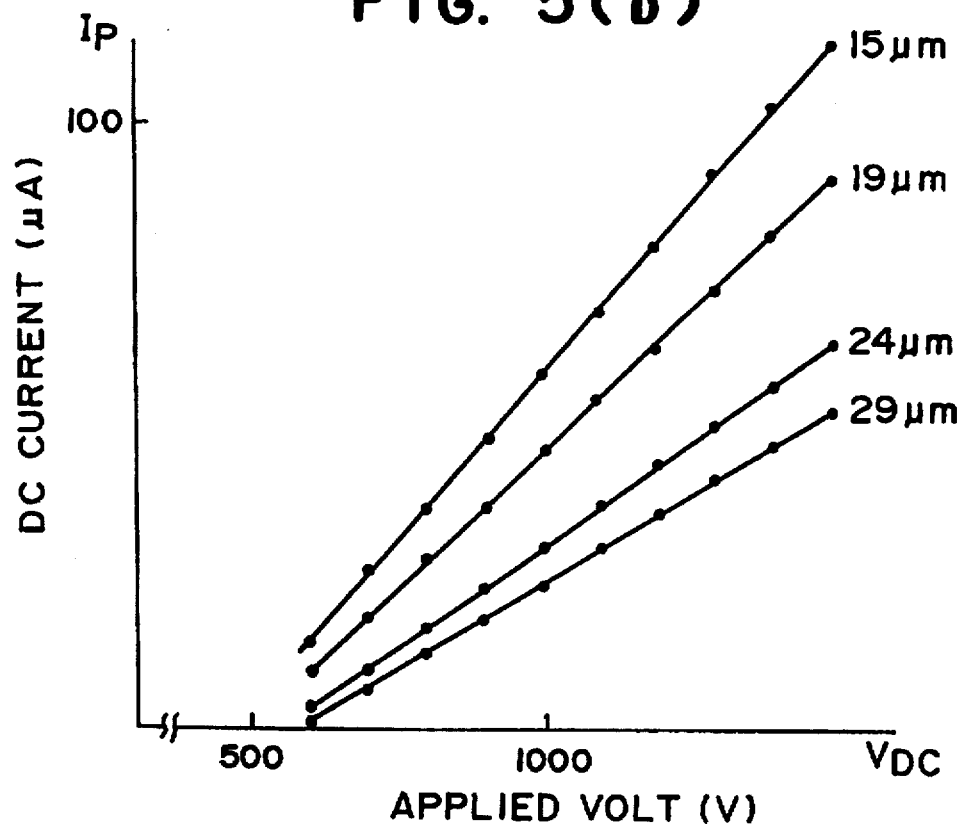

In FIG. 5, the straight line (24 microns) indicates the measurement result. The charging relative to the application DC voltage $V_{DC}$ has a threshold for each film thickness of the photosensitive layer as shown in FIG. 5(*a*), so that the charging starts at a specified voltage. The provided surface potential $V_D$ by the voltage application having an absolute value above the charge starting voltage has a liner relation indicated by rising inclination of 1.

The charge starting voltage is defined as follows. Only a DC voltage is applied to the image bearing member having a potential of 0 V, and the voltage is gradually increased. The surface potential of the photosensitive member is plotted relative to the application DC voltage on a graph. The DC potentials are plotted for every 100 V, and the first point is where the surface potential appears on the surface. Then, a line is drawn on the basis of least square approximation in statistics. The charge starting voltage is defined as a crossing point between the drawn line and the line indicating the surface potential 0. The line on the graph of FIG. 5 has been drawn using the least square approximation.

When the DC application voltage to the charging roller 2 is $V_{DC}$, and the surface potential on the OPC photosensitive drum 1 surface is $V_D$, and the charge starting voltage is $V_{TH}$, the following applies:

$$V_D=V_{DC}-V_{HT} \quad (1)$$

The formula derives from Paschen's Law.

Figure 6:
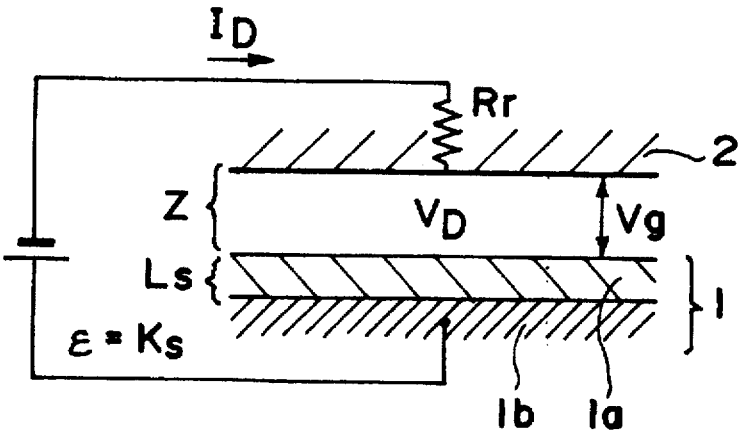
FIG. 6 shows an equivalent circuit of a microscopical space at the contact portion between the photosensitive member layer and the charging roller.

FIG. 6 shows an equivalent circuit of microscopical space Z at the contact portion between the charging roller 2 and the OPC photosensitive member layer. When the total resistance $R_r$ of the charging roller 2 is small, the voltage drop $I_D$Rr by the current $I_D$ through the photosensitive member layer 1*a* is neglibly small as compared with the $V_{DC}$. If $R_r$ is neglected, the voltage $V_g$ across the space Z is as follows:

$$Vg=V_{DC}\times Z/(L_s/K_s+Z) \quad (2)$$

$V_{DC}$: application voltage
Z: gap
$L_S$: photosensitive member layer thickness
$K_S$: photosensitive member layer dielectric constant The discharge phenomenon in the gap Z can be approximated by the following equations (3) and (4) by the Paschen law where Z is 8 microns or larger.

$$Vb=312+6.2Z \text{ (when } Vb>0) \quad (3)$$

$$Vb=-(312+6.2Z) \text{ (when } Vb<0) \quad (4)$$

Figure 7:
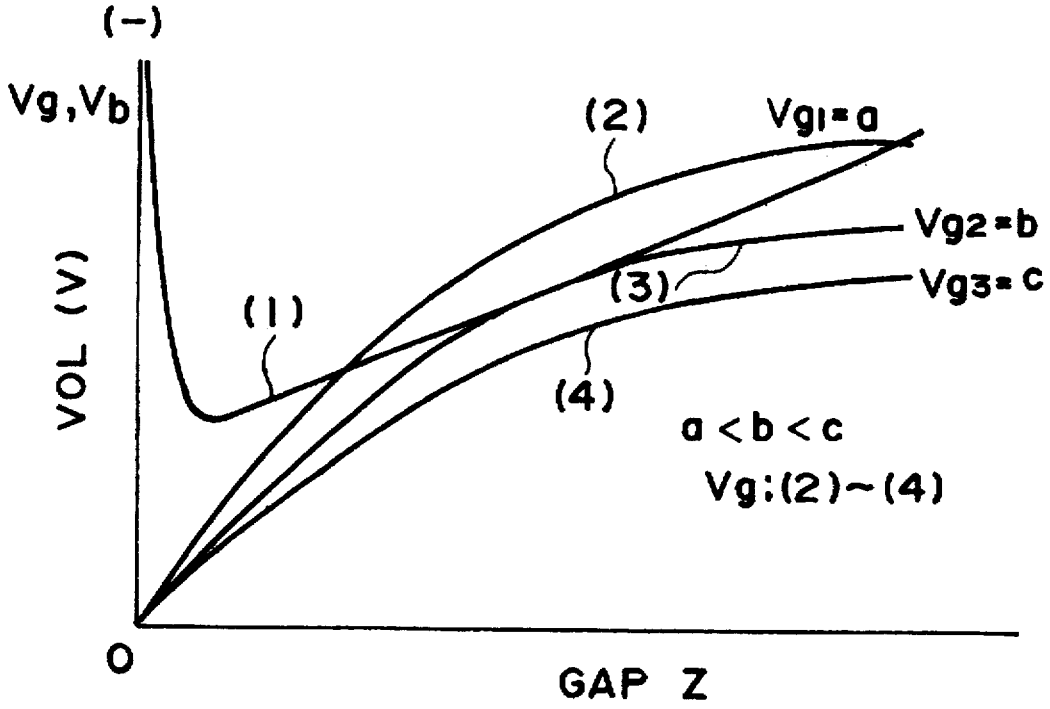
FIG. 7 shows a relationship between the GaP and the gap breakdown voltage.

Since Vb<0, the equations (2) and (4) are expressed in the graph as in FIG. 7. The abscissa indicates a gap distance Z, and the ordinate indicates the gap breakdown voltage. The convex down curve (2) is a Paschen curve, and the convex up curves (2), (3) and (4) indicate the property of the gap voltage Vg with the parameter of z. W hen the Paschen curve (1) and the curve (2)–(4) intersect, the discharge occurs. At the point of start of discharge, discriminant of quadratic equation relating to Z obtained by Vg=Vb, is 0. This means discharge start limit, and therefore, $V_{DC}=V_{TH}$.

The Paschen law relates to a discharge phenomenon in the discharge, but since a small amount of ozone is recognized immediately adjacent the charging portion and although the amount is very small ($10^{-2}$–$10^{-3}$ as compared with corona discharge), the charging by the charging roller is considered as involving the discharge phenomenon. Therefore, in order to control $V_D$ by $V_{DC}$, $$V_{DC}=V_R+V_{TH} \quad (5)$$

$V_R$: target surface potential is used to set the potential target value $V_R$, and by equation (5), $V_{TH}$ is determined, and it is added, by which the $V_D$ can be made close to $V_R$.

As will be understood from the formula, the threshold voltage $V_{TH}$ is determined by $$D=L_s/K_s \quad (6)$$

Here, however, the dielectric constant $K_S$ of the photosensitive member layer changes under the influence of the temperature, humidity or the like around the photosensitive member, and the thickness $L_S$ of the photosensitive member layer decreases with use.

Therefore, the surface potential $V_D$ changes with the change of threshold voltage $V_{TH}$ due to the circumference ambience and degree of use. In other words, if the values of $K_S$ and $L_S$ are known, the DC voltage value $V_{DC}$ for providing the proper level of the surface potential $V_D$ can be determined.

Figure 8A:
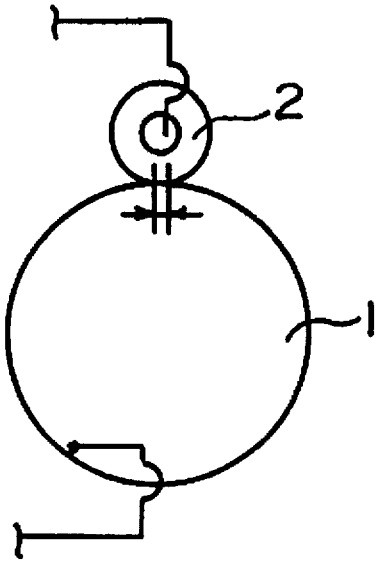
FIGS. 8(*a*) and 8(*b*) show a contact nip portion between a photosensitive member and a charging roller, and an equivalent circuit, respectively.
Figure 8B:
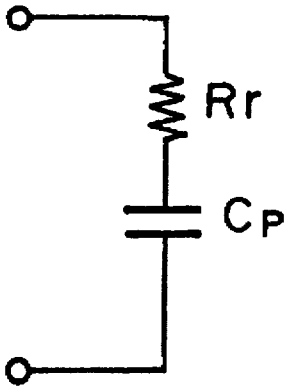

Here, the electrostatic capacity $C_P$ formed by the photosensitive drum 1 and the charging roller 2, as shown in FIG. 8, is provided by the nip n therebetween, and from the equivalent circuit of FIG. 6, it is as follows (is a contact area)

$$C_P=S_P\times K_s/L_S=S/D \quad (7)$$

Namely, $C_P$ is proportional to 1/D. Therefore, if $C_P$ is determined, the proper DC voltage $V_{DC}$ can be determined by the formula (5).

In this embodiment, in place of determining the $C_P$ of the drum, the change of charging property due to the change of the discharge impedance in response to the film thickness ($L_S$) of the CT layer as schematically shown, is measured, and on the basis of this, the application voltage is corrected.

Figure 9A:
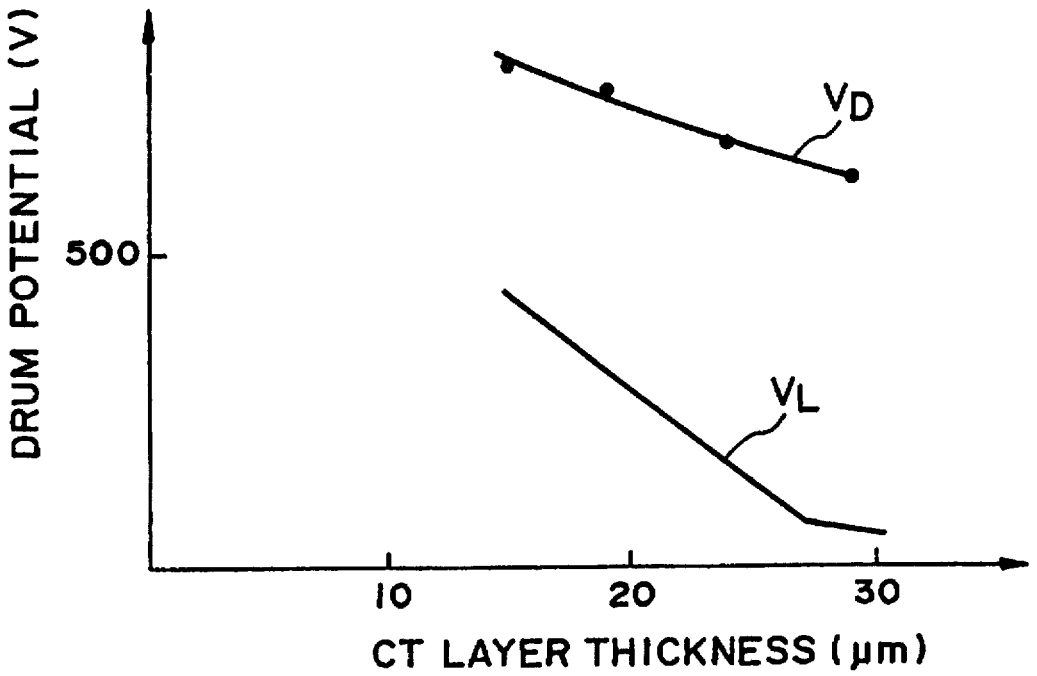
FIGS. 9(*a*) and 9(*b*) are graphs showing a dependency of a charging performance on the film thickness dependency.
Figure 9B:
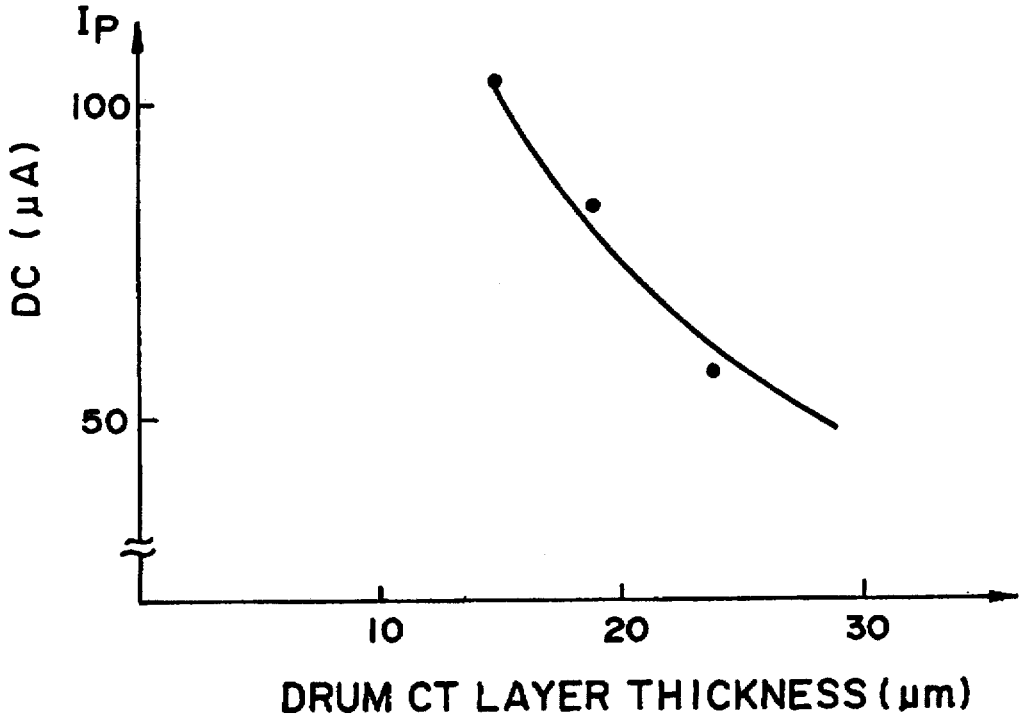

FIG. 9(*a*), shows the measurements of the application voltage and the charging roller 2 in relation to the drum surface potential for each drum CT layer thickness. The DC current amount detected at that time is shown in FIG. 9(*b*) of FIG. 9. As will be understood from Figure, the charging property, voltage-current characteristic and discharge start voltage change depending on the drum CT layer thickness.

FIGS. 9(*a*) and (*b*) show the property as the drum surface potential for the drum CT layer thickness during the constant voltage application of arbitrary voltage and the detected DC current. The relation between the drum surface potential and the detected DC current can be read out in accordance with the CT layer thickness. With the decrease of the CT layer thickness, drum surface potential (black potential $V_D$ and white potential $V_L$) and the detected DC current amount increase. By measuring the DC current amount during the constant voltage application of a particular level, the surface potential corresponding to the drum $C_P$ can be predicted.

Figure 10:
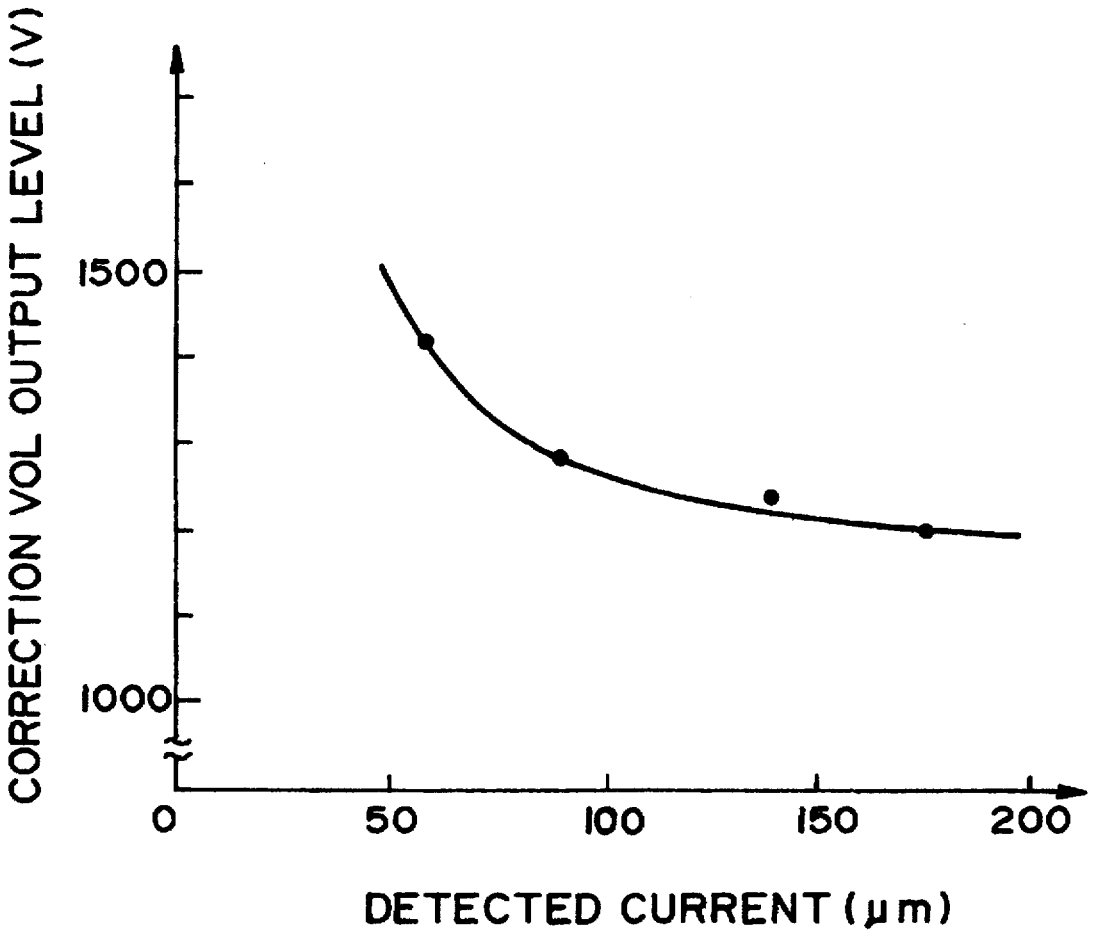
FIG. 10 shows a relationship between the detection voltage and the correction voltage output value.
Figure 11A:
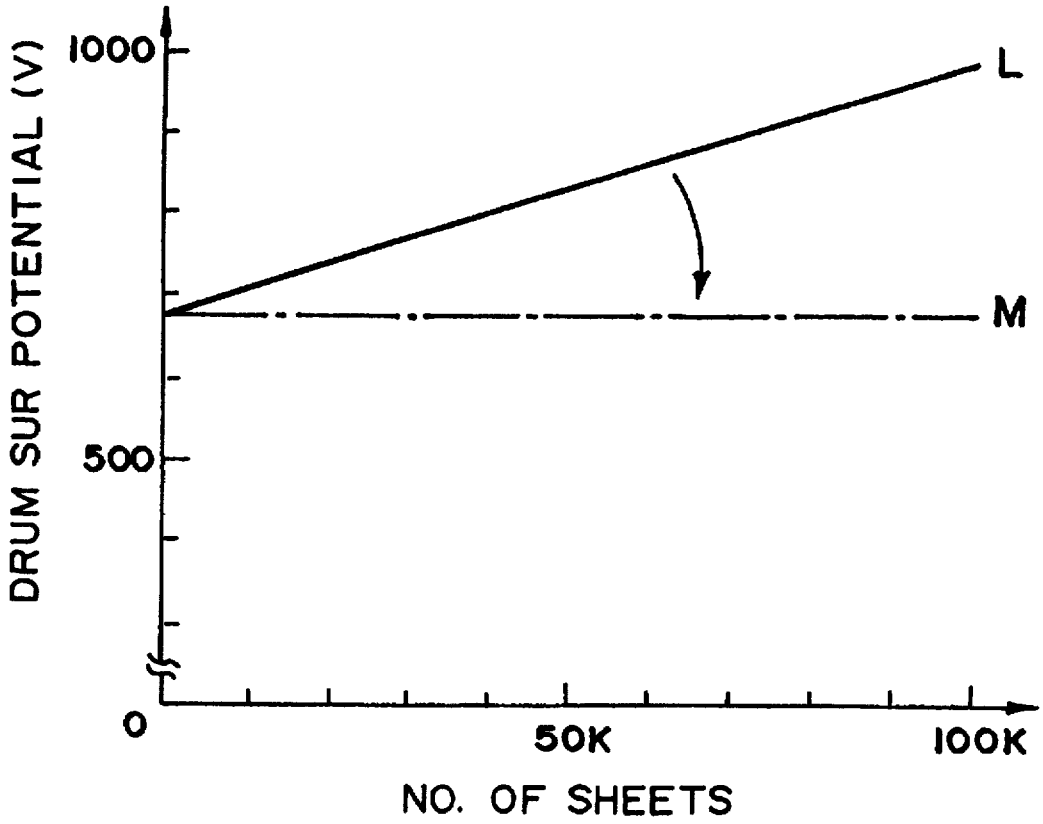
FIGS. 11(*a*) and 11(*b*) are graphs of changes of the surface potential and the photosensitive layer thickness due to long term use.
Figure 11B:
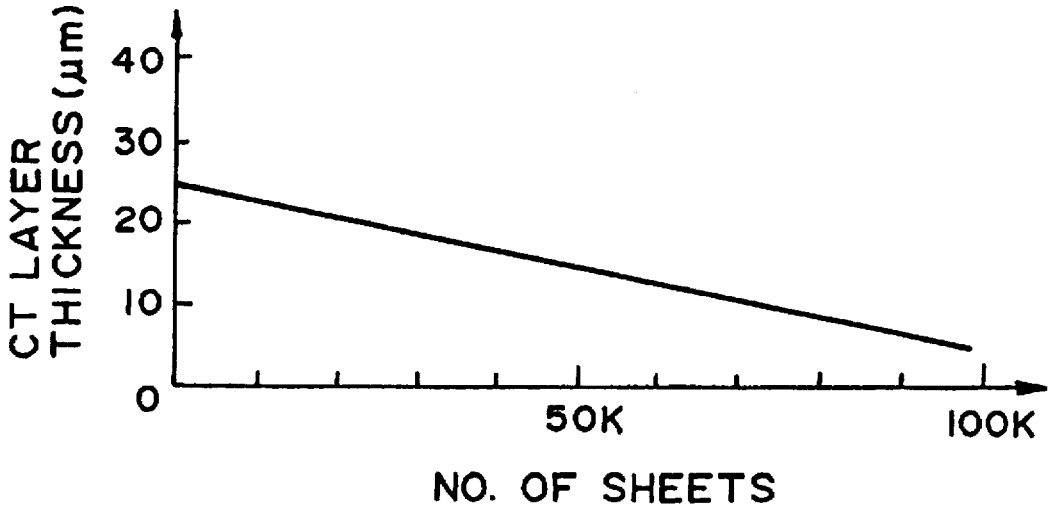

FIG. 10 shows detection current amount and the correction voltage output therefore for controlling the drum surface potential even if the $C_P$ change occurs due to the drum CT layer thickness change, from the foregoing relation. The correction is made to decrease the voltage output with the increase of the detection current amount. FIGS. 11(*a*) and 11(*b*) show the experiment results using the correction.

The abscissa represents the number of prints (number of image forming operations.), and the drum surface potential relative to the number of prints is plotted. The surface potential change in the case of the specified constant voltage application irrespective of the thickness of the assuring, is represented by L. According to this embodiment, the DC current amount during the constant voltage application is detected, and the graph is decreased in accordance with the increase of the current amount by the correction, and the constant voltage application is applied. By doing so, the constant drum surface potential can be assured even if the number of printing operations increases.

In the experiments, use is made with the above-described OPC photosensitive drum. The durability test was carried out with the image forming apparatus of FIG. 1.

As for the charging roller 2, as shown in in the layer structure model of FIG. 1, an electroconductive rubber layer 2*b* of EPDM or the like having a volume resistivity of $10^4$–$10^5$ Ohm.cm on a core metal 2*c*, and an intermediate resistance layer $2a_2$ of Hydrin rubber or the like having a volume resistivity j of approx. $10^7$–$10^9$ Ohm.cm is formed thereon. A blocking layer $2a_1$ (surface layer) of Nylon material having a volume resistivity of $10^7$–$10^{10}$ Ohm.cm (Torejin, trademark, available from TEIKOKU KAGAKU Kabushiki Kaisha) is formed thereon. It has a hardness of 50°–70° approx. by Asker-C measurement. The charging roller 2 is contacted to the photosensitive drum 1 with the total pressure 1600 g, and it is rotated thereby during the charging operation. The resistance of the entirety of the charging roller 2 is preferably, $10^6$–$10^9$ Ohm per 1 $cm^2$ of the roller surface.

When the resistance value rises due to the ambient humidity variation and the degree of use of the resistance layer of the charging member, the detection current amount decreases, and the voltage increase correction is imparted to the image portion application voltage value, and therefore, the charging is maintained sufficient to provide satisfactory image density and image quality.

On the other hand, the two previous detection currents through the charging roller are stored by the RAM4, and it is a possible alternative that only when two or more of the three including the current detection are the same, the constant voltage control is effected with the DC voltage corresponding thereto. By doing so, the proper APVC control is possible even if the detection current involves quite large variations, so that the stable image densities can be provided after a large number of operations.

Embodiment 2

In this embodiment, the image forming apparatus of FIG. 1 is modified by replacing the roller type fixing device 61 and 62 with a fixing device substantially different than the roller type fixing device. The structure except for the fixing device is the same, and therefore, the same reference numerals as in FIG. 1 are assigned to the elements having the corresponding functions, and detailed descriptions thereof are omitted for simplicity. As for the image fixing device, a film heating type fixing device (Japanese Laid Open Patent Application No. SHO-63-313182, Japanese Laid Open Patent Application No. HEI-2-157878 or the like), pressure fixing device, fixing device of magnetic or electromagnetic induction type is usable. They are operable substantially without the wait time, and therefore, the quick start is possible (copy start is possible substantially instantaneously with the actuation of the main switch).

Figure 12:
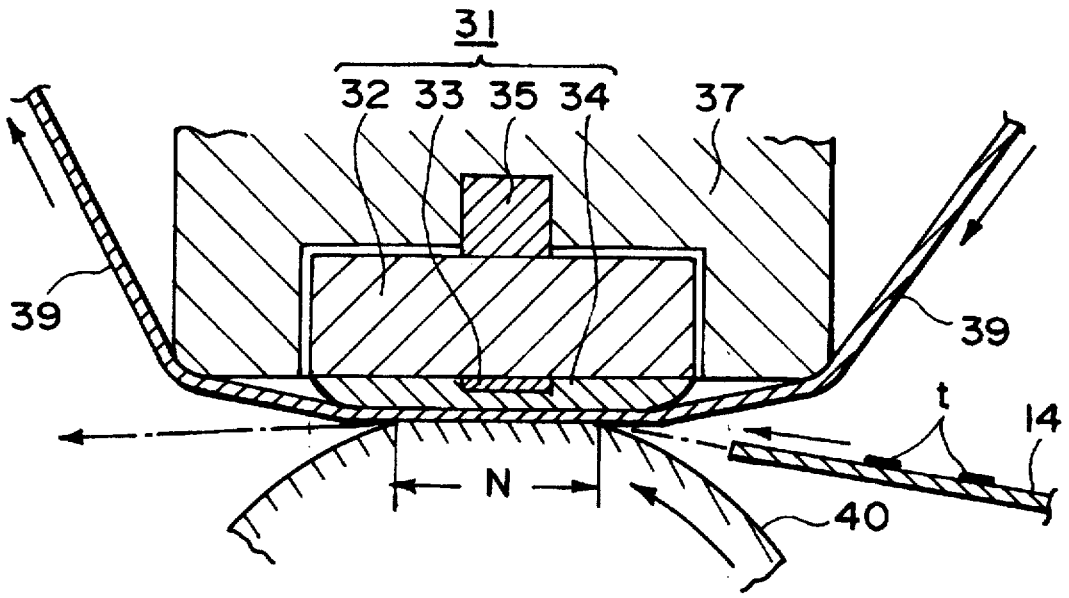
FIG. 12 is an enlarged cross-section and schematic view of a major part of a fixing device of film heating type.
Figure 13:
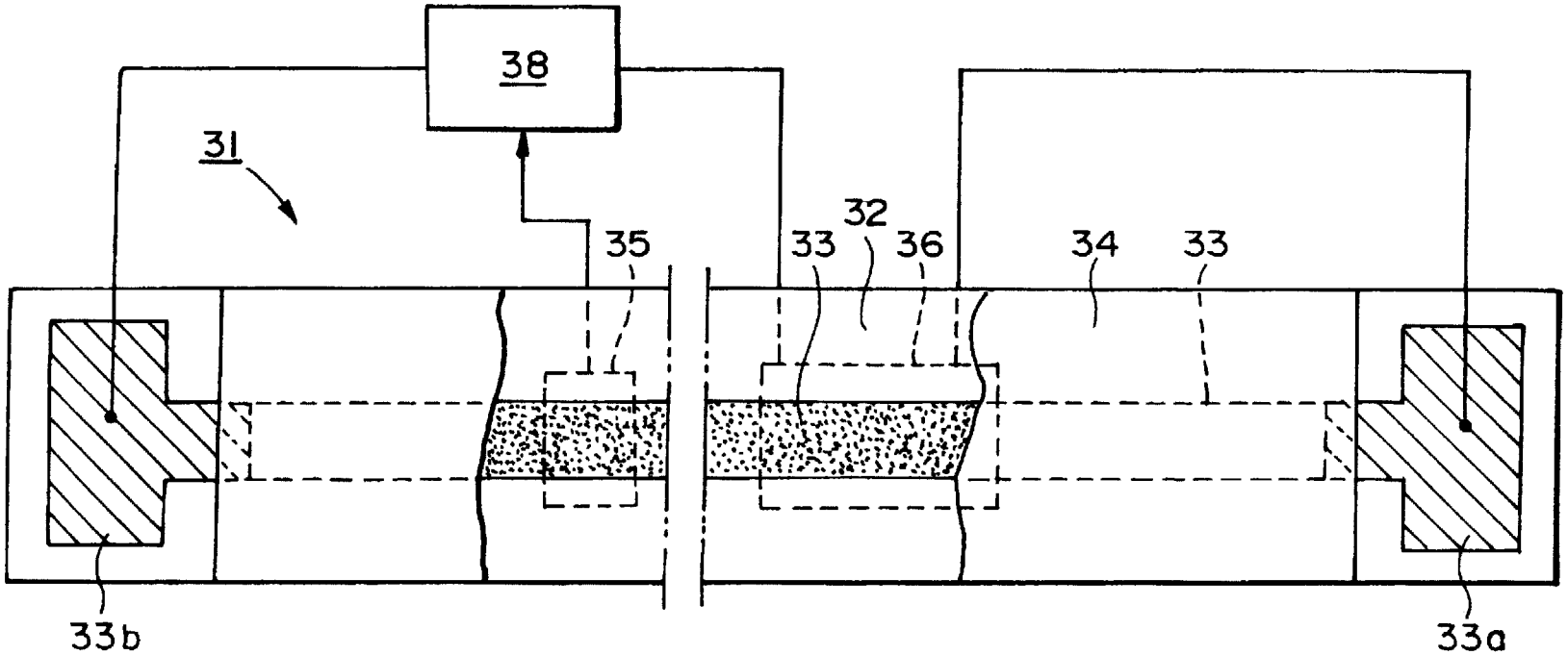
FIG. 13 is schematic top plan view partly broken, in which middle part of the heating member is omitted.

FIG. 12 shows a schematic enlarged cross-section of a major part of the film heating type fixing apparatus (heating apparatus). FIG. 13 is a top plan view partly broken with the middle portion omitted.

Designated by 31 is a heating member, which comprises a heat resistivity, electrical insulation property and low heater substrate (ceramic substrate) 32, a heat generating resistance layer 33 extending longitudinally on one side of the substrate 32, and a glass layer 34 (protection layer) covering the surface of the of the heat generating resistor on the substrate 32.

The surface of the glass layer 34 of the heating member 31 is a film contact sliding surface, and the surface of the glass layer 34 is exposed, and the heating member 31 is fixed on the supporting portion through the heat insulative heating member holder 37.

The voltage application is supplied from the power supply circuit 38 (FIG. 13) between the end electrodes (conductive layer) 33*a* and 33*b* of the resistance heat generating element layer 33, so that the resistance heat generating element 33 generates the heat.

Designated by 35 is a temperature detection element or the like contacted on the backside of the heater substrate 32 of the heating member 31, and the detected temperature information is supplied to the heating member temperature control system of the energization circuit 38, and the energization of the resistance heat generating element layer 33 is controlled to maintain the heating member temperature at a predetermined level.

Designated by 36 is a safety fuse as a thermal protector (temperature fuse), which is connected in series with the temperature for the resistance heat generating element layer 33, and then is contacted to the back surface of the heater substrate 32 of the heating member 31. When the temperature of the heating member 31 increases beyond the predetermined level, it fuses to shut off the power supply to the resistance heat generating element layer 33.

Designated by 39 is a heat resistive film or the like or polyimide of thickness of 40 microns approx., and 40 is a rotation pressing roller as a pressing member for pressing the film 39 to the surface of the glass layer 34 which is a film contact sliding surface of the heating member 31. Film 39 is urged to the heating member 31 by the pressing roller 40, and is moved at a predetermined speed in the direction indicated by an arrow by the rotation force of the pressing roller 40 or by another driving means, while the contact sliding with surface of the heating member 31 is maintained.

By the energization of the heat generating resister layer 33, the temperature of the heating member 31 rises to a predetermined level. While the film 39 is sliding relative to the heating member 31, the recording material 14 (the material to be heated) is introduced into the press-contact nip portion (fixing nip portion) between the film 39 and the pressing roller 40, so that the recording material 14 passes through the heating member 31 position with the film 39 in contact with the surface of the film 39. During the passage, thermal energy is supplied to the recording material 14 through the film 39 from heating member 31, so that the heating fusing and fixing is accomplished on the recording material 14.

In embodiment 1, the image heating and fixing device of heat roller type comprises the fixing roller provided with the heater inside the roller of metal, and an elastic pressing roller, and the recording material is passed through the fixing nip portion, by which the toner image is heated and pressed to fix the image.

However, the image heating and fixing device of the heat roller type has a large heat capacity, and therefore, a long time is required for the temperature of the roller to reach the predetermined temperature (rising or warming-up or waiting period). Additionally, in order to permit quick operation, the temperature control is required to attain a certain temperature level. The same applies to the fixing device of heat plate type, oven fixing system or like.

On the other hand, the film heating type device has advantages thereover. Since the low heat capacity heater is usable for the heating member 31, the waiting time can be reduced (quick stark is possible) as compared with the conventional heat roller type or the like, and therefore, the preheating when the apparatus is not used is not necessary. Thus, the overall power can be saved. Other problems of the other type can be eliminated.

Figure 14:
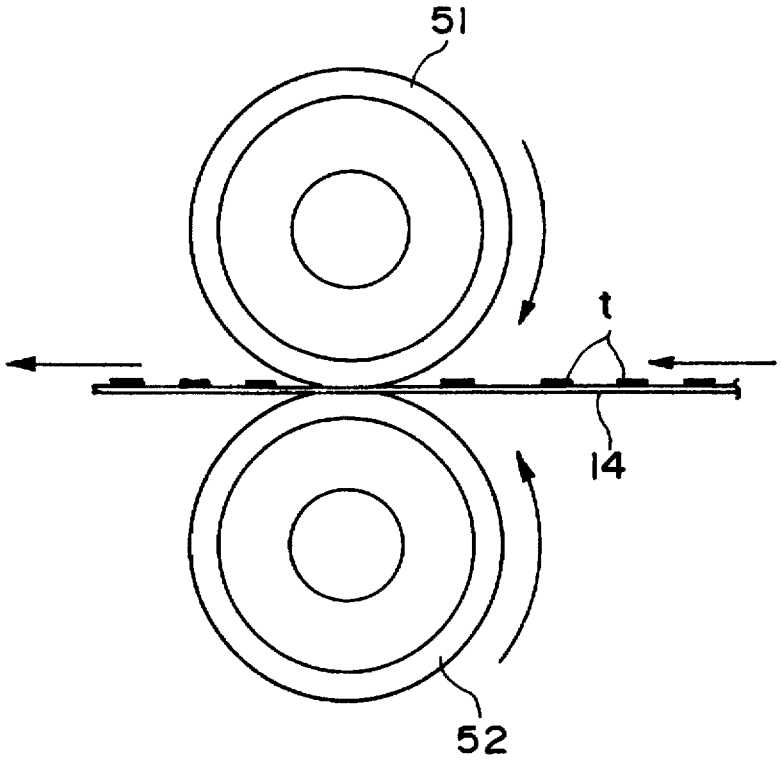
FIG. 14 is a schematic view of a pressure fixing device.
Figure 15:
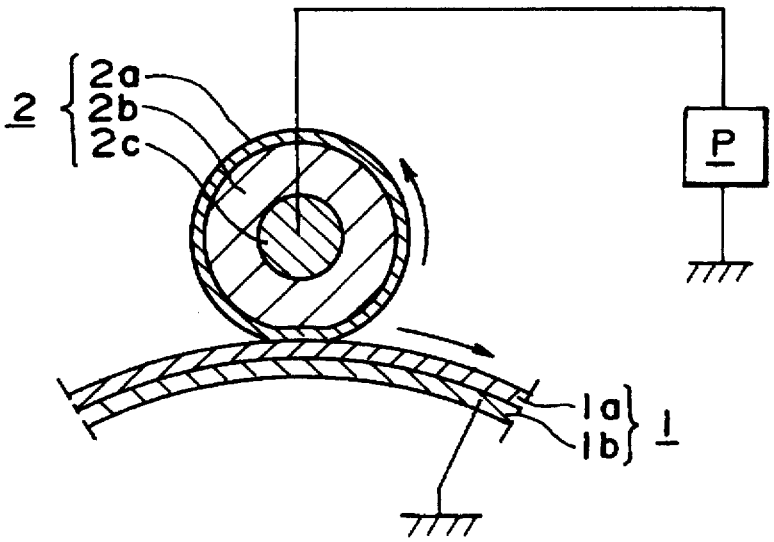
FIG. 15 is a schematic view of an example of a contact charging device.

FIG. 14 shows a pressure fixing device, wherein the recording material 14 carrying the unfixed toner image is introduced into the nip portion of the rigid member pressure rollers 51, 52 pressed to each other, and the unfixed toner image is fixed by the pressure. This system does not use the heat source so that the quick start is possible.

In the image forming apparatus having a fixing device not requiring the Waiting time as in FIG. 12- FIG. 14, it is desirable to provide an automatic shut-off function to automatically shut off the main switch of the apparatus if a predetermined time elapses without image forming operation.

In this case, if the APVC control (the charging roller is constant-voltage-controlled for the image formation with DC voltage based on the current through the charging roller) operates upon actuation of the main switch as disclosed in EP-A579499, the APVC controls are carried out many times in a day, and therefore, the charging roller is subjected to a constant voltage control for each variation of the current detection. For each variation, the density change occurs.

In this embodiment, the device is provided with a timer to solve the problem, and when the main power source is actuated within a predetermined time period after the automatic shut-off operated, the APVC control is not carried out, preferably, the current detection operation per se for the charging roller is not carried out. The predetermined period is properly determined on the basis of the frequency of the use of the device.

However, the APVC control may be carried out before the image formation on the first transfer material after each voltage source actuation without use of a timer. In this case, as described in embodiment 1, the voltage applied to the charging roller for the image formation is not changed even if the detected current changes between the Nth detection and the (N+1)th detection of the current through the charging roller. It is preferable that only when the (N+1)th current and (N+2) current are the same, the voltage applied to the charging roller for the image formation is changed in response to the current of the (N+2)th detection.

Even if the current thus detected changes, it is preferable that the image formation condition is not changed immediately after the current change in consideration of the variation or ambience variation, but the image formation condition is changed on the basis of the estimation that the thickness of the photosensitive layer decreases when the changed level continues a plurality of times.

Embodiment 3

Figure 16:
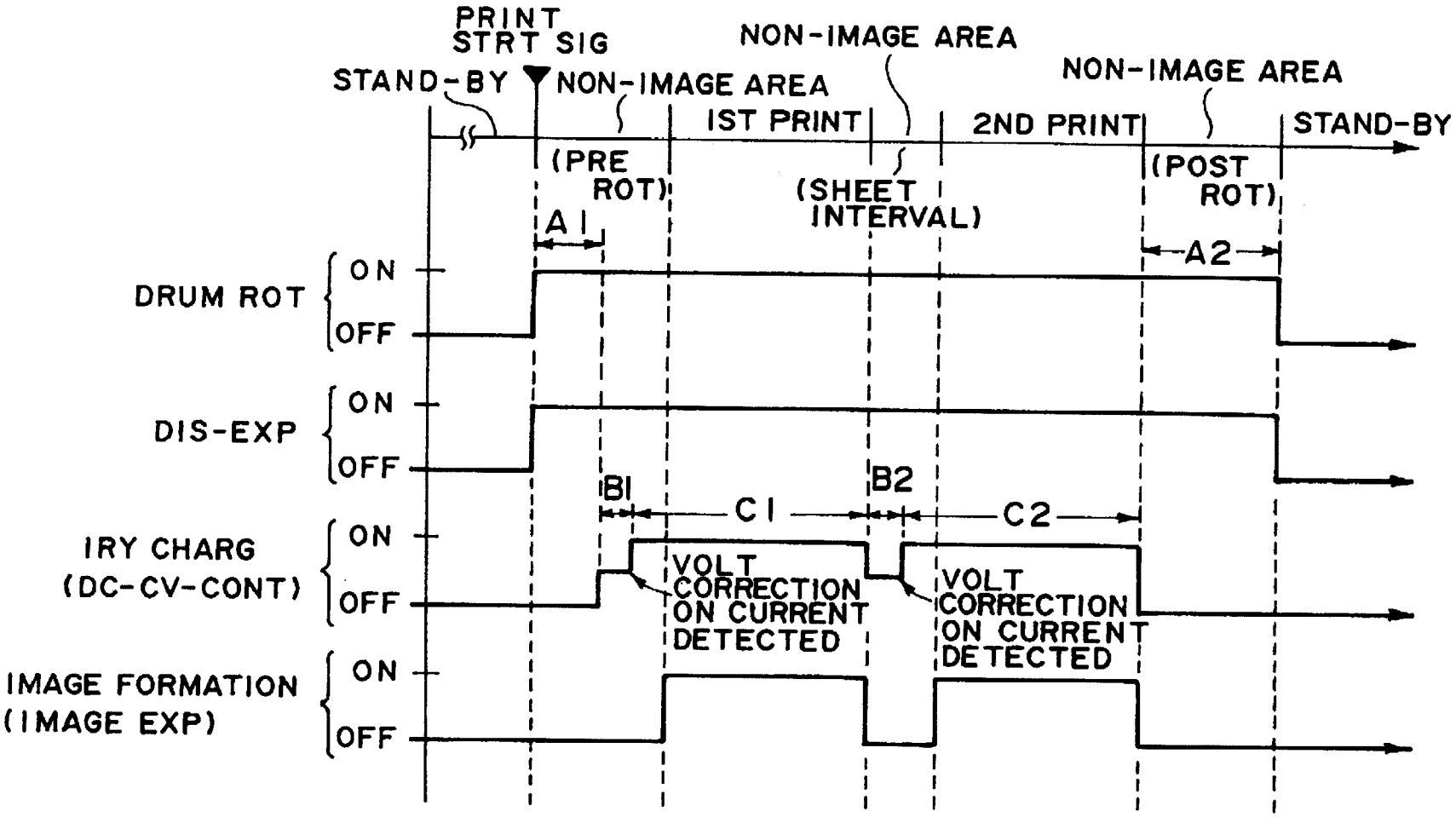
FIG. 16 shows an operation sequence.

FIG. 16 shows an example of other operation sequences of the image forming apparatus of FIG. 1. This exemplary shows a continuous print onto two transfer materials by one print start signal.

1. In response to print (copy) start signal, the rotation of the photosensitive member 1 of the device under the stand-by state is started, so that the front rotation period starts. Simultaneously with the rotation start of the drum 1, the discharging exposure device 15 is actuated, and the surface of the drum 1 is discharged through more than one full turn in the section A1.

2. Subsequently, the DC bias is applied as a primary charging bias to the charging roller 2.

3. The primary charging bias is first subjected to the constant voltage control in the section B1. And during this period, the DC current is detected. Then, charging roller DC constant voltage control is effected in accordance with the DC current thus detected.

The front rotation period is a period before the start of the image formation, and the portion of the surface of the drum 1 is a non-image formation region (more particularly, the region on which no image is going to be formed). The charging roller 2 is subjected to the DC constant voltage control during the section B1 within the front rotation period corresponding to the non-image formation region of the drum 1. The DC current at this time is detected, and a primary voltage correction (primary charging bias correction for the charging roller 2) is carried out.

4. Upon the start of the DC constant voltage control for the charging roller with the primary correction voltage, the image exposure is carried out for the first sheet through the slit. Now, the charging roller 2 corresponds to the image formation region of the drum 1 (the area on which the image is going to be formed), and the surface of the drum 1 is charged under the DC constant voltage control.

5. The surface portion of the drum corresponding to the interval between the adjacent sheet after the first sheet print and before the next sheet print, is a non-image formation region. In this embodiment, the DC constant voltage control is carried out for the charging roller 2 also during this sheet interval to effect the DC current detection. The roller application voltage for the image formation is corrected in response to the DC current.

After the completion of the first printing, the charging roller DC constant voltage control is carried out again during the section B2 (sheet interval), and the DC current detection is effected. Subsequently, the charging roller constant voltage control in accordance with the detection DC current is carried out in accordance with the detection DC current, for the next printing.

In the case of continuous printing for more than three sheets, the charging roller DC constant voltage control, the DC current detection and the DC constant voltage control operations are carried out similarly in the sheet interval.

6. When the image formation for the last sheet is completed, the drum is in the post-rotation period. In the post-rotation period A2 the drum 1 is subjected to discharging of the discharging exposure device 15 not less than one full turn. Then, the rotation of the drum 1 and the discharging exposure device are stopped. The device is placed in the stand-by state until the subsequent print start signal is produced.

When the drum surface is scraped with the result of a reduced photosensitive layer film thickness, the current detected during the periods B1 and B2, increases. The charging of the charging roller 2 is effected for the surface in the image formation region of the drum 1 under the charging roller DC constant voltage control with the decreased correction voltage, during the image formation.

In this embodiment, the DC current amount detected upon the application of the constant voltage application to the roller is stored. An average of two previous detected currents is used to correct the application voltage to be applied to the roller for the image formation. By doing so, the variation of the application voltage due to the variation of one current measurement can be prevented.

When the photosensitive drum is replaced, all of the data of the previous detections except for the latest one, are cleared, and then the DC current amount is detected multiple times with the constant voltage application to the roller (rest mode).

In the foregoing examples, the current value is detected with the constant voltage application to the roller, and during the image formation, the correction voltage is imparted. In place of the current detection, application voltage detection is usable with the constant current control, and for the image formation, constant current control may be effected with the correction current imparted, or they may be combined.

Figure 17:
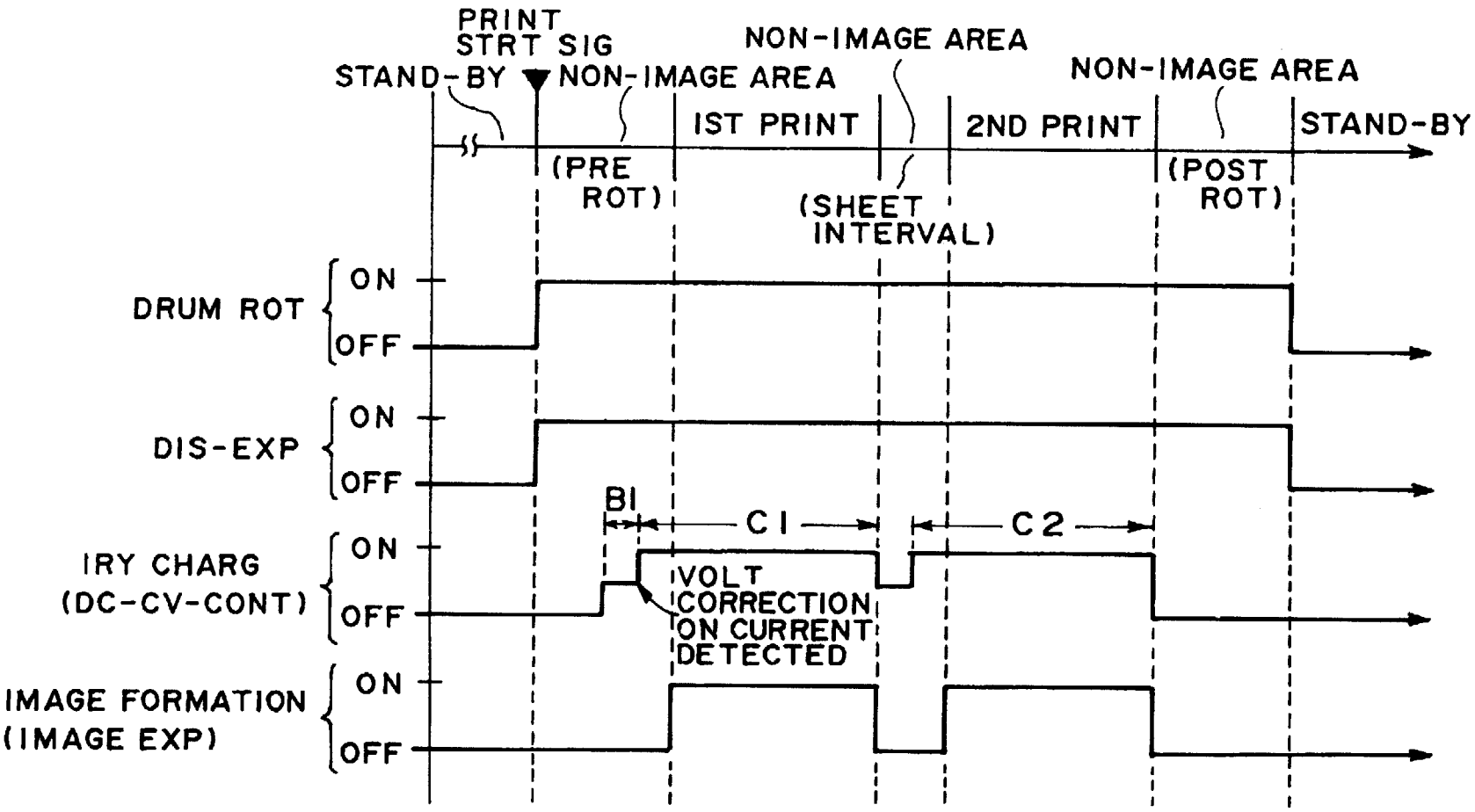
FIG. 17 shows an operation sequence.

Embodiment 4 (FIG. 17)

FIG. 17 shows another example. As compared with the sequence of FIG. 16, the DC constant voltage control for the charging roller 2 and the DC current detection are carried out only during the front rotation period B1 of the drum 1, and the DC constant voltage control and the DC current detection during the sheet interval are not carried out.

The charging roller constant voltage control in accordance with the DC current detected in the section B1, is carried out for each image formation in the continuous print.

However, the detection DC current and the correction voltage are renewed in the front rotation period B1 upon the next print start.

Figure 18:
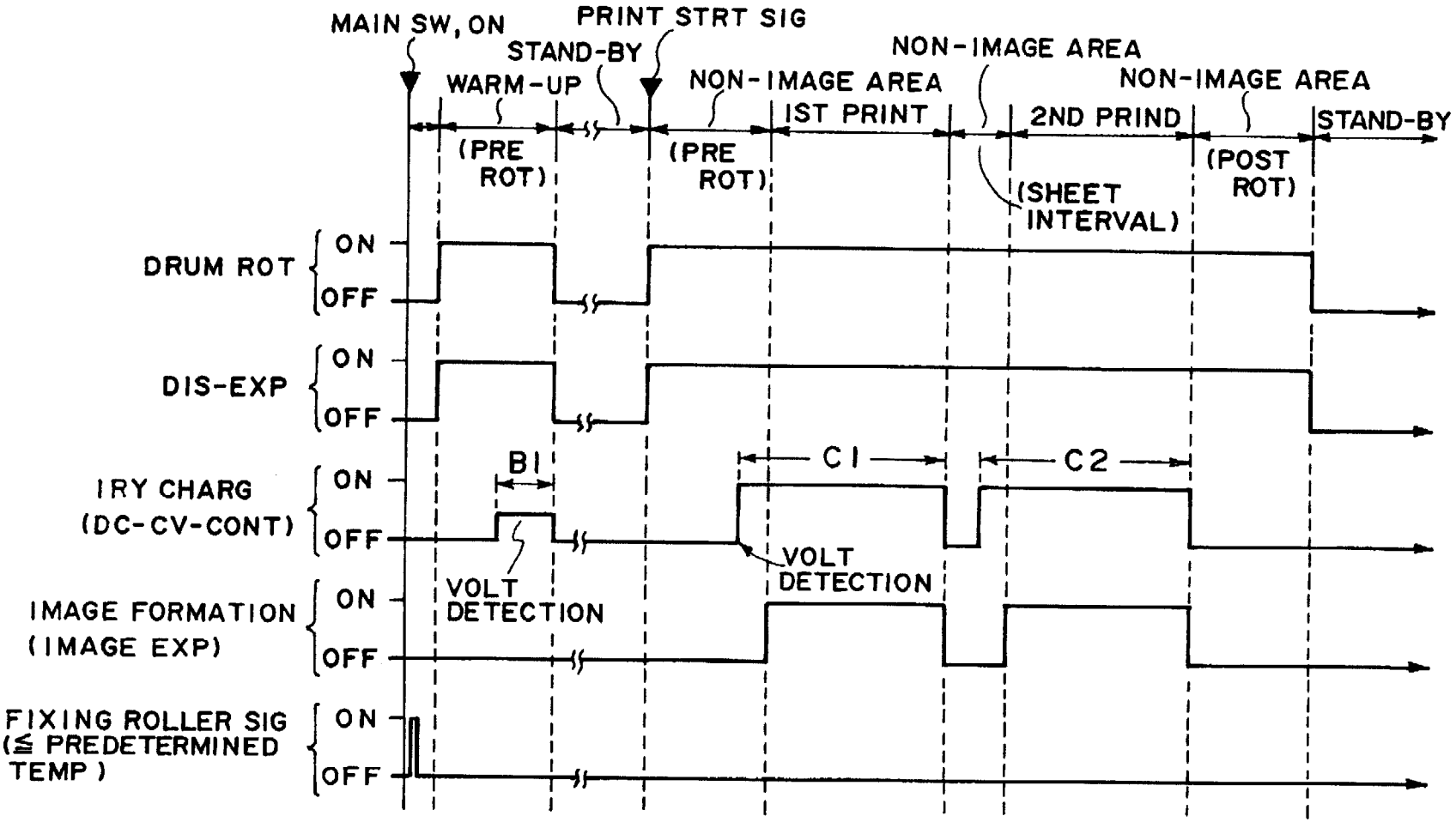
FIG. 18 shows an operation sequence.

Embodiment 5 (FIG. 18)

FIG. 18 shows a further example, wherein the DC constant voltage control for the charging roller 2 and the DC current detection are carried out during the device warming-up period when the main switch is actuated.

After the end of the warming-up period, the rotation of the drum, discharging exposure device are stopped, and the device is placed in the stand-by state.

The primary charging bias of the charging roller in each image formation cycle after production of the print start signal, is subjected to the DC constant voltage control with the correction voltage in accordance with the DC current detected during the DC constant voltage control in the warming-up period. Under this control, the image formation operation is carried out.

Once the detected current is stored, it is retained even if the next detection current is detected, and the application voltage is determined on the basis of the average of at least two detected currents.

Although not shown, the DC constant voltage control unshown and DC current detection for the charging roller 2 may be effected during the post-rotation after the image formation.

The rest mode is executed manually in the foregoing example, but it may be carried out automatically upon drum exchange. When the ambience variation or the like occurs suddenly, the front detection current value may be renewed by the previous data in response to the temperature/humidity sensor.

For each copy of predetermined number of copies (detected by the copy counter), the rest mode may be executed.

In any case, the influence of the variation of the detected current can be avoided.

In any of the foregoing embodiment, the image forming apparatus is provided with memory for storing detection current data of the charging roller. It is preferable that the data are kept even if the main power source is rendered off.

In the foregoing charging roller, the current through the photosensitive member from the charging roller is detected multiple times while the charging roller is subjected to the constant voltage control in order to recognize the thickness of the photosensitive layer. In place thereof, the voltages supplied to the charging roller from the voltage source subjected to the constant current control may be detected multiple times. The voltage for the constant voltage control of the charging roller is determined on the basis of the voltage detected multiple times.

In the foregoing embodiments, the constant voltage control of the charging roller is carried out for the image formation on the basis of the detection data, but it is a possible alternative to effect the constant current control of the charging roller for the image formation on the basis of the detection data.

While the invention has been described with reference to the structures disclosed herein, it is not confined to the details set forth and this application is intended to cover such modifications or changes as may come within the purposes of the improvements or the scope of the following claims.

What is claimed is:

1. Image forming apparatus comprising:

an image bearing member;

image formation means for forming an image on said image bearing member, said image formation means having a charging member contactable to said image bearing member to charge said image bearing member; and detection means for detecting a voltage—current characteristic between said image bearing member and said charging member, wherein an image formation condition for said image bearing member is determined on the basis of a plurality of detection operations of said detection means, and wherein the image formation condition is controlled on the basis of the latest voltage-current characteristic, only when the voltage-current characteristics obtained by the plurality of detection operations of said detection means are substantially the same.

2. An apparatus according to claim 1, wherein the said detection means detects said voltage—current characteristic by detecting a current flowing from said charging member to said image bearing member when a predetermined voltage is applied to said charging member.

3. An apparatus according to claim 1, wherein the detection means detects said voltage—current characteristic by detecting a voltage applied to said charging member when a predetermined current is applied to said charging member.

4. An apparatus according to claim 2, wherein said image formation condition is determined on the basis of a plurality of the detections of the current detected by said detecting means.

5. An apparatus according to claim 3, wherein said image formation condition is determined on the basis of a plurality of the detectives of the voltage detected by said detecting means.

6. An apparatus according to claim 2 or 3, wherein said image formation condition is a voltage on which said charging member is subjected to a constant voltage control.

7. An apparatus according to claim 2 or 3, wherein said image formation condition is a current on which said charging member is subjected to a constant current control.

8. An apparatus according to claim 1, wherein a datum of said voltage—current characteristic detected by said detection means, is stored after completion of image formation completion at least until said detection means performs a next detecting operation.

9. An apparatus according to claim 8, further comprising means for clearing datum of the voltage—current characteristic detected by said detection means.

10. An apparatus according to claim 1, wherein the detection operation of said detection means is effected for each actuation of a main voltage source of said apparatus.

11. An apparatus according to claim 10, wherein said main voltage source is automatically shut off when a predetermined time elapses without image forming operation.

12. An apparatus according to claim 11, further comprising fixing means for fixing an image on a recording material by a nip portion, said fixing means including a movable film, a heating member for heating said film by contact thereto, and cooperating with said film to form the nip portion, said fixing means further including a pressing member for urging the film to said heating member.

13. An apparatus according to claim 11, further comprising a fixing means for fixing an image on a recording material by a nip portion, and said fixing means including a pair of rollers press-contacted to each other, and the image is fixed substantially without heating.

14. An apparatus according to claim 1, wherein a DC voltage is applied to the charging member.

15. Image forming apparatus comprising:

an image bearing member;

image formation means for forming an image on said image bearing member, said image formation means having a charging member contactable to said image bearing member to charge said image bearing member; and detection means for detecting a voltage—current characteristic between said image bearing member and said charging member wherein an image formation condition for said image bearing member is determined on the basis of a plurality of detection operations of said detection means, and wherein the image formation condition is controlled on the basis of an average of the plurality of the detection operations.

16. An apparatus according to claim 15, wherein said detection means detects the voltage—current characteristic by detecting a current flowing from said charging member to said image bearing member when a predetermined voltage is applied to said charging member.

17. An apparatus according to claim 15, wherein said detection means detects the voltage—current characteristic by detecting a voltage applied to said charging member when a predetermined current is applied to said charging member.

18. An apparatus according to claim 16, wherein said image formation condition is determined on the basis of a plurality of the detections of the currents detected by said detecting means.

19. An apparatus according to claim 17, wherein said image formation condition is determined on the basis of a plurality of the detections of the voltages detected by said detecting means.

20. An apparatus according to claim 16 or 17, wherein said image formation condition is a voltage on which said charging member is subjected to a constant voltage control.

21. An apparatus according to claim 16 or 17, wherein the image formation condition is a current on which said charging member is subjected to a constant current control.

22. An apparatus according to claim 15, wherein a datum of the voltage—current characteristic detected by said detection means, is stored after completion of image formation completion at least until said detection means performs a next detecting operation.

23. An apparatus according to claim 18, wherein the image formation condition is determined on the basis of an average of the plurality of the detections of the currents.

24. An apparatus according to claim 19, wherein said image formation condition is determined on the basis of an average of the plurality of the detections of the voltages.

25. An apparatus according to claim 22, further comprising means for clearing datum of the voltage—current characteristic detected by said detection means.

26. An apparatus according to claim 15, wherein the detection operation of said detection means is effected for each actuation of a main voltage source of said apparatus.

27. An apparatus according to claim 26, wherein said main voltage source is automatically shut off when a predetermined time elapses without image forming operation.

28. An apparatus according to claim 27, further comprising fixing means for fixing an image on a recording material by a nip portion, said fixing means including a movable film, a heating member for heating said film by contact thereto, and cooperating with said film to form the nip portion, said fixing means further including a pressing member for urging the film to said heating member.

29. An apparatus according to claim 27, further comprising a fixing means for fixing an image on a recording material by a nip portion, and said fixing means including a pair of rollers press-contacted to each other, and the image is fixed substantially without heating.

30. An apparatus according to claim 15, wherein a DC voltage is applied to the charging member.

31. Image forming apparatus comprising:

an image bearing member;

image formation means for forming an image on said image bearing member, said image formation means having a charging member contactable to said image bearing member to charge said image bearing member; and detection means for detecting a voltage—current characteristic between said image bearing member and said charging member;

wherein an image formation condition for said image bearing member is determined on the basis of a plurality of detection operations of said detection means, and wherein a datum of said voltage—current characteristic detected by said detection means, is stored after completion of image formation completion at least until said detection means performs a next detecting operation.

32. An apparatus according to claim 31, wherein said detection means detects the voltage—current characteristic by detecting a current flowing from said charging member to said image bearing member when a predetermined voltage is applied to said charging member.

33. An apparatus according to claim 31, wherein said detection means detects the voltage—current characteristic by detecting a voltage applied to said charging member when a predetermined current is applied to said charging member.

34. An apparatus according to claim 32, wherein said image formation condition is determined on the basis of a plurality of the detections of the currents detected by said detecting means.

35. An apparatus according to claim 33, wherein said image formation condition is determined on the basis of a plurality of the detections of the voltages detected by said detecting means.

36. An apparatus according to claim 32 or 33 wherein said image formation condition is a voltage on which said charging member is subjected to a constant voltage control.

37. An apparatus according to claim 32 or 33, wherein said image formation condition is a current on which said charging member is subjected to a constant current control.

38. An apparatus according to claim 34, wherein said image formation condition is determined on the basis of an average of the plurality of the detections of the currents.

39. An apparatus according to claim 35, wherein said image formation condition is determined on the basis of an average of the plurality of the detections of the voltages.

40. An apparatus according to claim 31, further comprising means for clearing datum of the voltage—current characteristic detected by said detection means.

41. An apparatus according to claim 31, wherein the detection operation of said detection means is effected for each actuation of a main voltage source of said apparatus.

42. An apparatus according to claim 41, wherein said main voltage source is automatically shut off when a predetermined time elapses without image forming operation.

43. An apparatus according to claim 42, further comprising fixing means for fixing an image on a recording material by a nip portion, said fixing means including a movable film, a heating member for heating said film by contact thereto, and cooperating with said film to form the nip portion, said fixing means further including a pressing member for urging the film to said heating member.

44. An apparatus, according to claim 42, further comprising a fixing means for fixing an image on a recording material by a nip portion, and said fixing means including a pair of rollers press-contacted to each other, and the image is fixed substantially without heating.

45. An apparatus according to claim 31, wherein a DC voltage is applied to the charging member.

* * * * *

UNITED STATES PATENT AND TRADEMARK OFFICE

CERTIFICATE OF CORRECTION

PATENT NO. : 5,697,010

DATED : December 9, 1997

INVENTOR(S) : MASUDA et al.

It is certified that error appears in the above-identified patent and that said Letters Patent is hereby corrected as shown below: Title page, At [57] Abstract Line 2, "Imaging" should read --Image--.

Drawings:

Sheet 3

Figure 3, "CHARG" should read --CHARGE--.

Sheet 4

Figure 4, "CHARG" should read --CHARGE--.

Sheet 14

Figure 16, "CHARG" should read --CHARGE--.

Sheet 15

Figure 17, "CHARG" should read --CHARGE--.

Sheet 16

Figure 18, "CHARG" should read --CHARGE--.

Column 1

Line 12, " member " should read --members to be charged--.
Line 13, "to be charged" should be deleted.
Line 47, "exemplary," should read --example,--.

UNITED STATES PATENT AND TRADEMARK OFFICE

CERTIFICATE OF CORRECTION

PATENT NO. : 5,697,010

DATED : December 9, 1997

INVENTOR(S) : MASUDA et al.

It is certified that error appears in the above-identified patent and that said Letters Patent is hereby corrected as shown below:

Column 2

Line 30, "decrease," should read -- decreases, --.
Line 38, "the" (first occurence) should be deleted.

Column 4

Line 10, "exemplary" should read --example--.
Line 30, "exemplary" should read --example--.

Column 5

Line 33, "exemplary" should read --example--.

Column 7

Line 12, "neglibly" should read --negligibly--.
Line 33, "(2)" should read --(1)--.
Line 35, "W" should be deleted.
Line 36, "hen" should read --when--.

Column 8

Line 60, "in" (second occurrence) should be deleted.

Column 9

Line 52, "of the" (second occurrence) should be deleted.

UNITED STATES PATENT AND TRADEMARK OFFICE

CERTIFICATE OF CORRECTION

PATENT NO. : 5,697,010

DATED : December 9, 1997

INVENTOR(S) : MASUDA et al.

It is certified that error appears in the above-identified patent and that said Letters Patent is hereby corrected as shown below:

Column 10

Line 50, "or" should read --or the--.
Line 67, "Waiting" should read --waiting--.

Column 11

Line 43, "exemplary" should read --example--.

Signed and Sealed this

Twenty-eighth Day of July, 1998

Bruce Lehman

*Attest:*

BRUCE LEHMAN

*Attesting Officer*

*Commissioner of Patents and Trademarks*